United States Patent [19]

Almond et al.

[11] Patent Number: 5,064,308

[45] Date of Patent: Nov. 12, 1991

[54] GRAVITY DRAINAGE SYSTEM FOR ATHLETIC FIELDS AND METHOD THEREFOR

[76] Inventors: Daniel R. Almond, 7551 South Franklin St., Littleton, Colo. 80122; Joseph M. Stroemel, 4625 E. Louisiana Ave., E303, Denver, Colo. 80222; Stuart M. Cameron, 6308 S. Gallup Ct., Littleton, Colo. 80120

[21] Appl. No.: 669,768

[22] Filed: Mar. 15, 1991

[51] Int. Cl.[5] ..... E02B 13/00

[52] U.S. Cl. ..... 405/43; 405/50; 405/36; 47/48.5

[58] Field of Search ..... 405/36, 37, 43, 44, 405/45, 46, 50

[56] References Cited

U.S. PATENT DOCUMENTS

| | | | |
|---|---|---|---|
| 3,908,385 | 9/1975 | Daniel et al. | 61/11 |
| 4,023,506 | 4/1977 | Robey | 111/1 |
| 4,268,993 | 5/1981 | Cunningham | 47/58 |
| 4,678,582 | 7/1987 | Lavigne | 405/128 X |
| 4,832,526 | 5/1989 | Funkhouser, Jr. | 405/43 |
| 4,881,846 | 11/1989 | Burkstaller | 405/37 |
| 4,913,596 | 4/1990 | Lambert | 405/43 |

FOREIGN PATENT DOCUMENTS

| | | | |
|---|---|---|---|
| 2422772 | 12/1979 | France | 405/50 |
| 1288254 | 2/1987 | U.S.S.R. | 405/43 |

*Primary Examiner*—Randolph A. Reese
*Assistant Examiner*—Arlen L. Olsen
*Attorney, Agent, or Firm*—Dorr, Carson, Sloan & Peterson

[57] ABSTRACT

A gravity sub-drainage system for drainage of level-graded natural grass athletic fields. A plurality of parallel trenches are formed in a level-graded subgrade beneath the surface of the field. A main drainage system is provided at the lowest point of the subgrade. A collector pipe is placed into a trench at one end of the field sloping downward into the main drainage system. Perforated drain pipes are placed in the parallel trenches to slope downward toward the collector pipe and to slope downward toward the main drainage system to ensure that water collected from the surface will flow down into the collector pipe and into the main drainage system by the forces of gravity without the need for a mechanical pumping system.

A layer of pea gravel capable of draining at a preferred rate of eighteen inches per hour is placed around and above the perforated drain pipe up to a height of four inches above the top of the subgrade. A ten inch layer of ninety percent sand and ten percent peat moss capable of draining at a perferred rate of eighteen inches per hour is placed over the gravel layer. A level-graded layer of grass is formed over the mixture layer.

35 Claims, 3 Drawing Sheets

GRAVITY DRAINAGE SYSTEM FOR ATHLETIC FIELDS AND METHOD THEREFOR

BACKGROUND OF THE INVENTION

1. Field of the Invention

This invention relates to the field of drainage systems for athletic fields, particularly for natural grass fields.

2. Statement of the Problem

The drainage of athletic playing fields has been a longstanding problem. The earliest athletic fields were level-graded, natural grass fields. These fields tended to have poor drainage, causing water to collect on the surface and subsurface. Activity on the fields under these conditions tended to cause damage to the fields as well as hinder the activity on the fields. Providing the fields with a crowned surface to enhance the drainage did little to alleviate the problem.

Artificial surface athletic fields were developed partially to solve this problem. However, artificial surface playing fields are expensive to install and maintain, retain heat on the surface of the field, and most importantly, increases the risk of injury to persons partaking in activity on the artificial surface fields. Artificial surface fields also require crowned surfaces for surface drainage which can create problems with depth perception and with other injuries.

Several approaches have attempted to solve the problems associated with natural grass fields and artificial surface fields by the use of subdrainage. These approaches are relatively expensive and cumbersome.

One such approach is disclosed in U.S. Pat. No. 3,908,385 for a planted surface conditioning system. This system uses a watertight barrier placed over the compacted subsoil beneath the playing field. A series of slitted drain pipes are laid over the barrier under the playing field. A layer of porous sand is then placed over the drain pipes with a mixture layer of different soils placed over the sand to form a rooting medium for the grass. A vacuum pump is utilized to pump the water from the playing field to prevent accumulations of water on the surface or subsurface.

U.S. Pat. No. 4,268,993 discloses a natural grass surface subdrainage system using a watertight membrane placed over a sloping-graded subgrade. A layer of gravel is placed over the membrane with a series of slitted drain pipes placed over the gravel on a level horizontal grade to maintain a water table in the gravel layer. A layer of sand is placed over the drain pipes and gravel layer to anchor the grass. A series of valves and water sensor stations monitor and maintain the water table beneath the surface. The system is primarily used to subirrigate the field.

U.S. Pat. No. 4,913,596 discloses a natural grass athletic field construction using a sloped subgrade having lateral trenches formed therein. Slitted drain pipes are laid into the trenches with a layer of gravel laid over the pipes, a layer of crushed stone laid over the gravel layer, a layer of sand laid over the crushed stone layer, and a layer of soil mixture laid over the crushed stone layer with grass on the soil mixture layer. A plastic reinforcement matting is spaced from the upper surface two inches into the soil mixture. Each individual layer of sand, gravel and stone has an infiltration level of at least 9 inches per hour, with the soil layer having an infiltration rate of 5 to 9 inches per hour. The upper surface is crowned to enhance the drainage of the field.

The above described systems are typical of the approaches for providing subdrainage for natural grass athletic fields. These systems require expensive construction methods and materials. Also, the use of watertight membranes increase the cost of installation 20 and maintenance as well as providing additional opportunities for problems to arise. The cost of the systems are above the ability of all but professional sports teams or athletic departments having large budgets to afford to install and maintain. These approaches also fail to consider the problems of rootzone drainage and of the layering effects of the subsoil mixtures.

A need exists for a drainage system for natural turf athletic fields that is economical to install and maintain, that is effective to drain high rates of rain or irrigation, and that will decrease the probability of injury.

3. Solution to the Problem

The present invention solves these and other problems by providing a gravity drainage system for natural turf athletic fields.

The present invention provides a subdrainage system using gravity to drain the subsurface of the athletic field.

The present invention provides a system that is relatively inexpensive to install and requires little mechanical maintenance after installation.

The present invention provides a system that provides adequate drainage after the rootzone of the grass surface is established.

The present invention provides a system that is easily adaptable to fit the needs of a specific site.

The present invention provides a system that is easy to clean and maintain.

These and other features of the present invention will become evident from the following description taken in conjunction with the drawings.

SUMMARY OF THE INVENTION

The present invention provides a system for drainage of level-graded natural grass athletic fields. The system uses sub-drainage of the grass fields by gravity to eliminate the need for mechanical pumping or the need for watertight liners beneath the surface.

The system uses a plurality of parallel trenches formed in a level-graded subgrade beneath the surface of the field. The surface of the subgrade may include portions sloping downward into the trenches to prevent water from collecting on the top of the subgrade. A main drainage system such as a storm sewer is provided at the lowest point of the subgrade. A collector pipe is placed into a trench at one end of the field sloping downward into the main drainage system. If necessary, the collector pipe can be broken into sections, each sloping downward, so that the main drainage system can be placed at a midpoint on the field.

Perforated drain pipes are placed in the parallel trenches to slope downward toward the collector pipe. The perforated drain pipes also slope downward toward the main drainage system as well. This downward slope ensures that water collected from the surface will flow down into the collector pipe and into the main drainage system by the forces of gravity without the need for a mechanical pumping system. The ends of the perforated drain pipes away from the collector pipe are accessible to allow the pipes to be flushed as needed.

A layer of pea gravel having a diameter between $\frac{1}{4}$ and $\frac{3}{8}$ inch is placed around and above the perforated drain pipe up to a height of four inches above the top of the subgrade. The gravel is carefully selected so that the layer will drain at a preferred rate of eighteen inches per hour. If desired, electrical heating cables can be buried two inches below the upper surface of the gravel layer to heat the field. The top surface of the gravel layer is graded level.

A ten inch layer of sand and peat moss is placed over the gravel layer. The layer is mixed to be ninety percent sand and ten percent peat moss. The sand and peat moss are carefully selected according to high quality control standards to prevent layering within the mixture and to reduce infiltration of the voids of the gravel layer while promoting the growth of the rootzone. The mixture layer is selected to drain at a preferred rate of eighteen inches per hour.

A level-graded layer of grass is formed over the mixture layer. The grass can be seeded or sprigged if time or conditions allow, or sodded if necessary. The system is designed so that once the root system has fully developed, the surface and subsurface will drain at a minimum rate of five inches per hour.

This system will quickly drain a flat, natural grass field without the need of mechanical assistance. Once installed, the system requires little maintenance. The careful selection of grasses with a proper fertilization and irrigation program will provide a durable field which will normally not require extensive repairs. The system can be readily adapted for a variety of site conditions and climate limitations. These and other features will become evident from the following description of a preferred embodiment taken in conjunction with the drawings.

DETAILED DESCRIPTION OF A PREFERRED EMBODIMENT

The present invention provides a system for draining level-graded, natural grass athletic fields. This system uses subdrainage of the natural grass fields by gravity to drain the fields at a minimum rate of five inches per hour even after the grass has fully developed the rootzone in the subsoil of the field. The system is designed to be carefully installed under strict quality control of the construction techniques and material choice. The system can be easily adapted to specific site requirements and climate restrictions. The system can be installed in new athletic fields or retro-fitted into existing fields. The use of a flat, level-graded natural grass field provides a desirable athletic playing surface.

Figure 1:
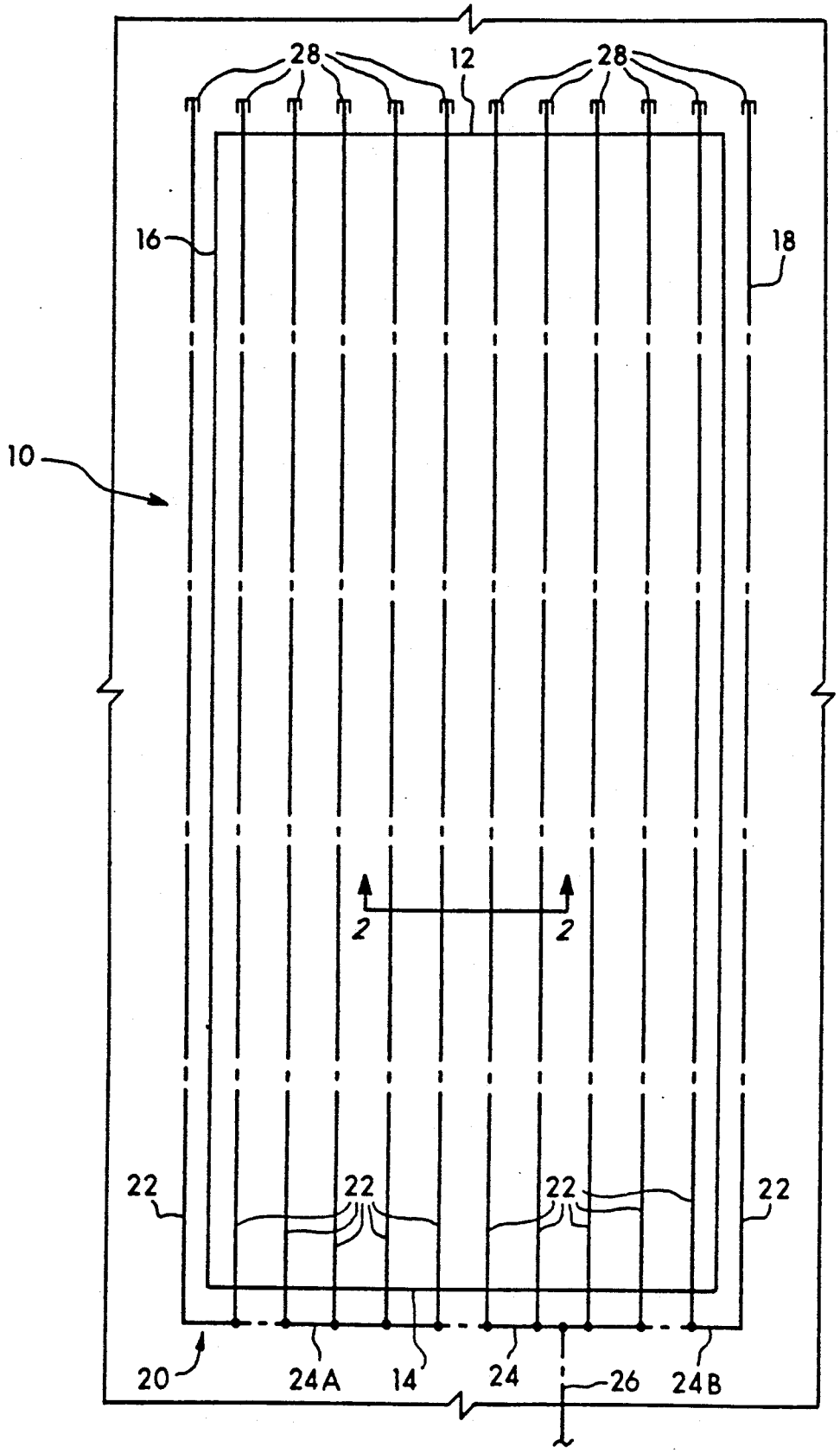
FIG. 1 is a top view of an athletic field with the layout of a preferred embodiment of the present invention installed.
Figure 2:
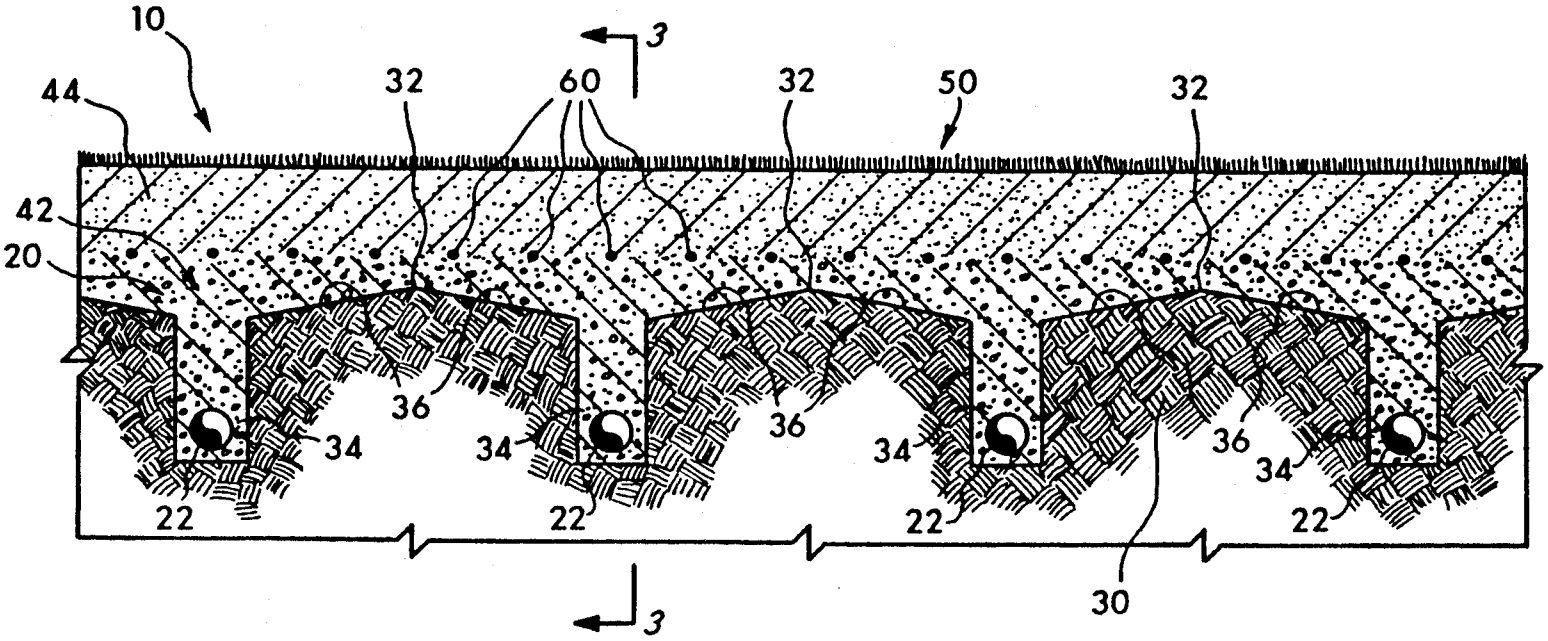
FIG. 2 is a end view along lines 2—2 of FIG. 1 showing a cross section the subdrainage system.
Figure 3:
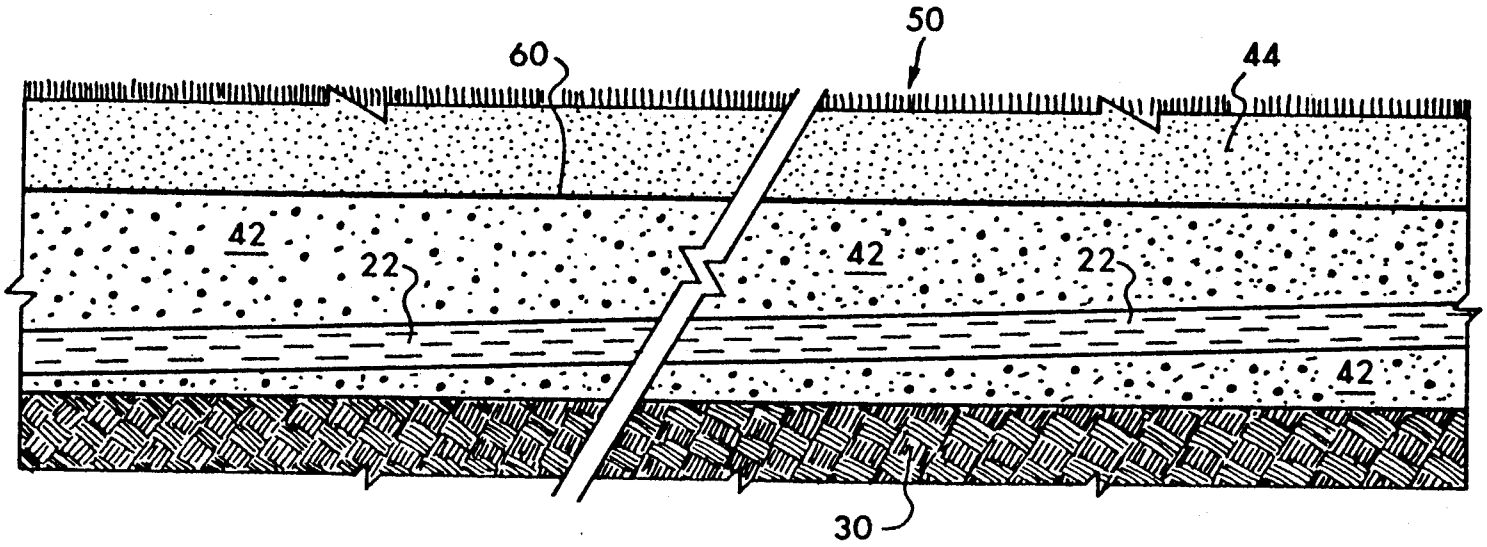
FIG. 3 is a side view of the cross section along lines 3—3 of FIG. 1.

A preferred one of a number of possible embodiments is illustrated in FIGS. 1-3. The ensuing description of a preferred embodiment is for explanatory purposes only and is not meant to limit the scope of the claimed inventive concept. Other embodiments and variations are considered to be within the range of the claimed invention.

The embodiment illustrated in FIG. 1 shows a typical layout for a football field 10. Field 10 has a rectangular shape having end zones 12, 14 and sidelines 16, 18. The claimed invention is not to be limited by this configuration. The system of the present invention is designed to be usable on any of a number of different athletic playing fields. For example, the system can be adapted for soccer fields, golf courses, grass tennis courts, polo fields, cricket fields, etc.

Subdrainage system 20 includes perforated drain pipes 22, collector pipe 24, and main drain pipe 26 as shown in FIG. 1. Main drain pipe 26 extends to a storm sewer system or other such system that conducts the drainage away from the site of field 10. A cross sectional view of subdrainage system 20 is illustrated in FIG. 2. Field 10 has a compacted subgrade 30. Subgrade 30 has a level-graded upper surface 32 with a series of parallel trenches 34 having a typical width of eight inches and a typical depth of eight inches that varies as necessary for placement of perforated drain pipes 22 as discussed below.

Trenches 34 extend longitudinally the length of field 10 beyond end zones 12, 14. Trenches 34 are typically spaced sixteen feet apart from one another across the field beyond the sidelines 16, 18. The distance between trenches 34 can be changed as desired up to a spacing of twenty-five feet. Upper surface 32 of subgrade 30 includes portions 36 between trenches 34 sloping downward towards trenches 34 at a slope of approximately five percent. The sloping of upper surface 32 prevents water from collecting on top of subgrade 30 and funnels the drainage into trenches 34 and perforated drain pipes 22.

Main drain pipe 26 extends from field 10 at the lowest point of subgrade 30 so that it is lower than collector pipe 24 and drain pipes 22. Collector pipe 24 is typically a twelve inch diameter PVC pipe placed in a trench (not shown) beyond end zone 14 and substantially perpendicular to trenches 34. Collector pipe 24 is placed in the trench to slope downward towards main drain pipe 26 and is connected to main drain pipe 26. As shown in FIG. 1, main drain pipe 26 is located near a mid portion of end zone 14. Therefore, in this embodiment, collector pipe 24 has two portions **24*a*, 24*b* which both slope downward towards main drain pipe 26 so that drainage which is collected by collector pipes 24*a*, 24*b* will drain into main drain pipe 26** due to the force of gravity.

Perforated drain pipes 22 are placed in trenches 34 to extend from beyond end zone 12 to collector pipe 24. Drain pipes 22 are typically high density corrugated polyethylene heavy duty pipe. In the present embodiment, drain pipes 22 have a four inch diameter with slits formed about the circumference of the pipes. Drain pipes 22 are placed in trenches 34 so each drain pipe 22 slopes downward towards collector pipe 24 at a one percent slope as illustrated in FIG. 3. Each drain pipe 22 also slopes downward towards main drain pipe 26 at a one percent slope. This assures that water entering perforated drain pipes 22 will flow downward into collector pipe 24 and into main drain pipe 26 due to the forces of gravity without the need for mechanical pumping. Drain pipes 22 include access openings 28 at their ends opposite of collector pipe 24. This allows drain pipes 22, collector pipe 24 and main drain pipe 26 to be flushed and cleaned by simply pumping water through access openings 28 through the entire system.

The present invention is not meant to be limited to this configuration. Other variations are considered within the inventive concept. For instance, trenches 34 may extend laterally or diagonally across the field or collector pipe 24 need not be perpendicular to perforated drain pipes 22 or extend along end zone 14. Collector pipe 24 may extend laterally across midfield of field 10 with drain pipes 22 sloping downward from both sides of field 10.

A layer 42 of pea gravel is placed around each drain pipe 22 and extends above upper surface 32 of subgrade 30 to a height of about four inches. Layer 42 is designed to drain at least 12 inches per hour and at a preferred rate of eighteen (18) inches per hour. The pea gravel of the preferred embodiment is selected to have a diameter between ¼ inch and ⅜ inch and to be free of lumps of clay, soil or vegetative material. The upper surface of layer 42 is graded level.

A layer of sand and peat moss mixture 44 is placed on top of pea gravel layer 42 to a depth of approximately ten inches. The upper surface of layer 44 is graded level. Layer 44 is mixed to be ninety percent sand and ten percent peat moss. The sand is selected according to the following specifications: At least seventy-five percent of the sand has a particle size between 0.25 mm and 1.0 mm, less than one percent of the sand has a particle size less than 0.10 mm and less than two percent of the sand has a particle size larger than 1.0 mm. The silt and clay content of the sand does not exceed two percent of the total sand in a textural analysis.

The peat moss is selected according to the following specifications: The peat moss must be at least eighty-five percent well decomposed organic matter and be uniform in texture. The clay and silt content is sufficiently low so that the final rootzone mixture, after the roots from the grass fully develops, is less than five percent silt and less than three percent clay. The pH level of the peat moss is between 6.5 and 7. The peat moss is free from extraneous material such as sticks, roots, rocks, etc.

The selection and mixture of the gravel, sand and peat moss is critical. In the prior art systems, the use of organic material in the subsoil mixture slows the drainage of water through this layer. Also, the use of a variety of soils and organic materials causes a layering effect. The various soils and organic materials tend to separate and create a series of layers beneath the surface. This slows the drainage of water through this layer. The sand, soil, and organic material will also infiltrate the layer of gravel and fill the voids between the gravel. This inhibits drainage through the gravel layer.

The system of the present invention utilizes carefully selection of the materials and control of the depth of the layers so that layering of the subsoil mixture and infiltration of the voids of the gravel layer will be minimized. The selection of the peat moss and the amount of peat moss used is determined so the root growth of the grass surface is initially encouraged. As the root growth develops, sufficient water and nutrients will be retained by the roots so that additional organic material is not necessary. The fully developed root growth will slow the drainage of water through the subsoil layer. By using an adequate fertilization program, the grass will be established and vigorously grow to withstand the wear and tear of use.

The selection of the sand will prevent infiltration into the voids of the gravel layer. The sand is essentially an inert material with the necessary drainage rates. Each layer of the subdrainage system is selected to have a drainage rate of at least 12 inches per hour and preferably eighteen inches per hour. This will assure that even after the rootgrowth is fully developed, the field will still drain at a minimum rate of five inches per hour. This drainage rate will provide a sufficiently dry playing surface for most locations and uses.

The upper surface of field 10 is typically a layer of grass 50. Preferably the grass 50 is provided by seeding or sprigging when time and conditions permit. If necessary the grass 50 can be provided by sodding. The upper surface is provided as a flat, level-graded surface without the crown of previous fields. The grass can be maintained without damage or bare spots even through heavy use by a properly selected fertilization program that will promote vigorous growth.

Electrical heating cables 60 are provided in system 20 buried two inches below the top of gravel layer 42 as shown in FIG. 2. These cables provides heat to layer 44 and to the roots of grass layer 50 to prevent the ground from freezing and promote the growth of the grass. The depth of cables 60 allows gradual heating of the subsurface without causing thermal shock to the grass. In locations where the climate permits or where the use does not require winter activity, heating cables 60 can be omitted.

An above-ground irrigation system is used along with a carefully selected fertilization program to nurture the growth and maintenance of the grass field. Proper selection of the grasses, and maintenance of the field will create a durable surface that is economical to maintain.

Once the subdrainage system 20 is in place and the grass has fully developed, there is little mechanical maintenance of the system. Rainfall or irrigation will drain from the surface and subsurface of the field at a minimum rate of five inches per hour, even with a fully developed root system. It is likely that the fields would drain at rates much higher than this, in the range of eight to ten inches per hour. Rainfalls above this five inches per hour would tend to stop activity on the field in most situations.

During or after a rainfall or irrigation, the water will drain through the grass surface layer into the subsurface. The water will drain through the sand layer 44 and the gravel layer 42 and into the trenches 34. The sloped portions 36 of the subgrade 30 will also drain the water into the trenches 34. The water will seep into drain pipes 22 through the perforations formed in the drain pipes. The downward slope of the drain pipes 22 will cause the water to run into collector pipes 24 and into the main drain pipe 26 which will carry the water away from the site of the field into a storm sewer, reservoir, river or the like. Even if the water is draining into the trenches faster than the system can dispose of it, the water will simply rise within the gravel layer until the system can drain it or else move horizontally through the gravel layer to the main drainage site.

The only mechanical maintenance necessary other than care of the grass would be periodically flushing the system by running water through the access openings 28 of the drain pipes 22. This can be done periodically, after heavy usage or after periods of non-use, or as necessary.

The drainage system of the present invention provides an economical and durable system for draining a flat, level-graded, natural grass athletic system. It eliminates the need for expensive mechanical drainage systems and the need for crowned surfaces. The system is simple and inexpensive to maintain and operate after installation. The system is easily adaptable to a variety of site conditions and climate conditions.

The above description is for explanatory purposes only and is not meant to limit the scope of the invention as claimed. Other variations and embodiments are considered to be within the scope and range of the claimed inventive concept.

I claim:

1. A gravity drainage system for a level-graded natural grass athletic field, said system comprising:

a level, compacted subgrade;

drainage means at the lowest point of said subgrade for draining water from the site of said field;

collector drain pipe means, connected to end drainage means, placed in a trench formed in said subgrade and sloping downward toward said drainage means for collecting runoff;

a plurality of parallel trenches formed in said subgrade spaced a predetermined distance from one another;

perforated drain pipes, connected to said collector drain pipe means, placed in each of said trenches sloping downward toward said collector drain pipe means and sloping downward toward said drainage means;

a layer of pea gravel placed around and above said perforated drain pipe forming a level-graded upper layer, said pea gravel layer having a drainage rate of at least 12 inches per hour;

a level layer of a non-layering mixture placed above said pea gravel layer and having a drainage rate of at least 12 inches per hour, said non-layering mixture formed of approximately ninety percent sand and ten percent peat moss; and a layer of natural grass on the top of said sand and peat moss mixture layer forming a flat, level-graded athletic field.

2. The system of claim 1 wherein said system includes an overall drainage rate of at least 5 inches per hour when said natural grass establishes full root growth.

3. The system of claim 2 wherein the particle size of said sand of said mixture layer has following specifications:

at least seventy-five percent of said sand has a particle size between 0.25 millimeters and 1.0 millimeters;

less than one percent of said sand has a particle size smaller than 0.10 millimeters;

less than two percent of said sand has a particle size larger than 1.0 millimeters; and the silt and clay content of said sand does not exceed two percent of the total of said sand in textural analysis.

4. The system of claim 2 wherein said peat moss of said mixture layer has the following specifications:

at least eighty-five percent of said peat moss comprises well-decomposed organic material and uniform in texture;

has a silt and clay content sufficient to hold the final rootzone mixture to less than five percent silt and three percent clay;

have a pH level between 6.5 and 7.0; and is free from extraneous materials.

5. The system of claim 2 wherein said pea gravel layer consists gravel having a particle size between one-quarter inch and three-eights inch diameter; and has a depth of approximately eight inches above the top of said trenches.

6. The system of claim 1 wherein said plurality of trenches extend longitudinally the length of said field.

7. The system of claim 1 wherein said predetermined distance is less than twenty-five feet.

8. The system of claim 1 wherein said predetermined distance is typically sixteen feet.

9. The system of claim 1 wherein said perforated pipe is placed in said trenches at a slope of one percent downward toward said collector pipe means.

10. The system of claim 1 wherein said perforated pipe is placed in said trenches at a slope of one percent downward toward said drainage means.

11. The system of claim 1 wherein said subgrade includes the portions between said trenches formed sloping downward towards said trenches to prevent water from collecting on said subgrade.

12. The system of claim 11 wherein said portions include a five percent slope downward towards said trenches.

13. The system of claim 1 wherein said perforated drain pipes includes access means for flushing said perforated drain pipes.

14. The system of claim 1 wherein said system further comprises means buried approximately six inches above the top of said trenches in said pea gravel for heating said field.

15. A gravity drainage system for a level-graded natural turf athletic field, said system comprising:

a level-graded layer of vegetative growth;

a first sub-layer of non-layering material for draining water from said vegetative growth layer, said first sub-layer of non-layering material includes approximately ninety percent sand and ten percent peat moss said first sub-layer capable of draining at a minimum rate of 12 inches per hour without a fully developed root growth in said first sub-layer and at a minimum rate of five inches per hour when said vegetative growth layer has a fully developed root growth in said first sub-layer;

a compacted subgrade beneath said vegetative growth layer;

drainage means at the lowest point of said subgrade for draining water away from the site of said field;

collector pipe means, connected to said drainage means, placed in a trench formed in said subgrade and sloping toward said drainage means for collecting runoff;

a plurality of trenches formed in said subgrade spaced a predetermined distance from one another;

perforated drain pipes placed in each of said trenches; and a second sub-layer formed of pea gravel placed around and above said perforated drain pipes directly beneath said first sub-layer capable of draining water at a rate of at least 12 inches per hour.

16. The system of claim 15 wherein said sand of said first sub-layer has the following specifications:

at least seventy-five percent of said sand has a particle size between 0.25 millimeters and 1.0 millimeters;

less than one percent of said sand has a particle size smaller than 0.10 millimeters;

less than two percent of said sand has a particle size larger than 1.0 millimeters; and the silt and clay content of said sand does not exceed two percent of the total of said sand in textural analysis.

17. The system of claim 15 wherein said peat moss of said first sub-layer has the following specifications:

at least eighty-five percent of said peat moss is well-decomposed organic material and uniform in texture;

said peat moss has a silt and clay content sufficient to hold the final rootzone mixture to less than five percent silt and three percent clay;

have a pH level between 6.5 and 7.0; and is free from extraneous materials.

18. The system of claim 15 wherein said second sublayer consists of gravel having particle sizes of between one-quarter inch and three-eights inch diameter; and has a depth of approximately eight inches above the top of said trenches.

19. The system of claim 15 wherein said predetermined distance is less than twenty-five feet.

20. The system of claim 15 wherein said predetermined distance is typically sixteen feet.

21. The system of claim 15 wherein said perforated pipe is placed in said trenches at a slope of one percent downward toward said collector pipe means.

22. The system of claim 15 wherein said perforated pipe is placed in said trenches at a slope of one percent downward toward said drainage means.

23. The system of claim 15 wherein said subgrade includes the portions between said trenches formed sloping downward towards said trenches to prevent water from collecting on said subgrade.

24. The system of claim 23 wherein said portions include a five percent slope downward towards said trenches.

25. The system of claim 15 wherein said perforated drain pipes includes access means for flushing said perforated drain pipes.

26. The system of claim 15 wherein said system further comprises means buried approximately two inches below the upper layer of said pea gravel for heating said field.

27. A method of draining a level-graded natural turf athletic field, said method comprising the steps of:

forming a level-graded subgrade;

providing a drainage means at the lowest point of said subgrade for draining water away from the site of said field;

placing a collector drain pipe in a trench formed in said subgrade sloping downward toward said drainage means;

connecting said collector drain pipe to said drainage means;

forming a plurality of parallel, spaced trenches in said subgrade the length of said field;

placing perforated drain pipes in each of said trenches to slope downward towards said collector drain pipe and downwards towards said drainage means;

connecting said perforated drain pipes to said collector drain pipe;

placing a layer of pea gravel capable of draining at a rate of at least 12 inches per hour around and above said perforated drain pipe to a depth of approximately eight inches above the top of said trenches;

placing a level-graded layer of a mixture of approximately ninety percent sand and ten percent peat moss capable of draining at a minimum rate of 12 inches per hour; and forming a level-graded layer of vegetative grown on top of said mixture layer to form a flat, level-graded athletic field.

28. The method of claim 27 wherein said step of placing said mixture layer includes using sand having the following specifications:

at least seventy-five percent of said sand has a particle size between 0.25 millimeters and 1.0 millimeters;

less than one percent of said sand has a particle size smaller than 0.10 millimeters;

less than two percent of said sand has a particle size larger than 1.0 millimeters; and the silt and clay content of said sand does not exceed two percent of the total of said sand in textural analysis.

29. The method of claim 27 wherein said step of placing said mixture layer includes using peat moss having the following specifications:

at least eighty-five percent of said peat moss is well-decomposed organic material and uniform in texture;

said peat moss has a silt and clay content sufficient to hold the final rootzone mixture to less than five percent silt and three percent clay;

have a pH level between 6.5 and 7.0; and is free from extraneous materials.

30. The method of claim 27 wherein said step of placing said mixture layer includes the step of using materials selected to be non-layering over time.

31. The method of claim 27 wherein said step of placing said gravel layer includes using gravel of a particle size of between one-quarter inch and three-eights inch diameter.

32. The method of claim 27 wherein said step of forming said trenches includes selecting said predetermined distance to be typically sixteen feet.

33. The method of claim 27 wherein said step of forming said subgrade includes forming the portions between said trenches sloping downward towards said trenches to prevent water from collecting on said subgrade.

34. The method of claim 27 wherein said step of placing said perforated drain pipes includes providing access means for flushing said perforated drain pipes.

35. The method of claim 27 wherein said method further comprises providing means buried approximately two inches below the upper layer of said pea gravel for heating said field.

* * * * *